US010090579B2

(12) United States Patent
Fan

(10) Patent No.: US 10,090,579 B2
(45) Date of Patent: Oct. 2, 2018

(54) ANTENNA, ANTENNA CONTROL METHOD, AND MOBILE TERMINAL

(71) Applicant: ZTE CORPORATION, Shenzhen, Guangdong Province (CN)

(72) Inventor: Jingyun Fan, Shenzhen (CN)

(73) Assignee: ZTE CORPORATION, Shenzhen, Guangdong Province (CN)

( * ) Notice: Subject to any disclaimer, the term of this patent is extended or adjusted under 35 U.S.C. 154(b) by 141 days.

(21) Appl. No.: 15/030,722

(22) PCT Filed: Jun. 23, 2014

(86) PCT No.: PCT/CN2014/080549

§ 371 (c)(1),
(2) Date: Apr. 20, 2016

(87) PCT Pub. No.: WO2015/058543

PCT Pub. Date: Apr. 30, 2015

(65) Prior Publication Data

US 2016/0285152 A1 Sep. 29, 2016

(30) Foreign Application Priority Data

Oct. 21, 2013 (CN) ..... 2013 1 0496696

(51) Int. Cl.
*H01Q 1/24* (2006.01)
*H01Q 3/01* (2006.01)
*H01Q 1/36* (2006.01)

(52) U.S. Cl.
CPC ..... *H01Q 1/243* (2013.01); *H01Q 1/36* (2013.01); *H01Q 1/364* (2013.01); *H01Q 3/01* (2013.01)

(58) Field of Classification Search
CPC ..... H01Q 1/24; H01Q 1/36; H01Q 3/013
(Continued)

(56) References Cited

U.S. PATENT DOCUMENTS 6,906,680 B2 * 6/2005 Rawnick ..... H01Q 1/38 343/700 MS
7,262,734 B2 * 8/2007 Wood ..... H01Q 1/366 343/701

(Continued)

FOREIGN PATENT DOCUMENTS

CN 102969562 A 3/2013
CN 102969562 A 3/2013

(Continued)

OTHER PUBLICATIONS

International Search Report (Form PCT/ISA/210) for International Application No. PCT/CN2014/080549 dated Oct. 9, 2014.

(Continued)

*Primary Examiner* — Huedung Mancuso

(57) ABSTRACT

Provided is an antenna, a method for controlling an antenna and a mobile terminal. The antenna includes: a base plate, controlling apparatus, and driving apparatus, wherein M*N microcell units are provided in the base plate, each of the microcell units is in communication with neighboring microcell units, and liquid metal is provided in the multiple microcell units. The driving apparatus is connected with a controller and the base plate respectively, wherein the controlling apparatus generates a control signal according to one of the pre-stored control matrixes, and sends the control signal to the driving apparatus. Elements of the control matrix correspond to the microcell units in the base plate in a one-to-one manner, so as to control whether the liquid metal is kept in the corresponding microcell units. The driving apparatus drives, according to the control signal sent by the controlling apparatus, the liquid metal in the microcell units to flow in the microcell units. A metal body formed by the liquid metal serves as an antenna of a terminal (Continued)

application component. The disclosure improves the radiation performance of the antenna.

9 Claims, 3 Drawing Sheets

(58) Field of Classification Search
USPC ..... 343/702
See application file for complete search history.

(56) References Cited

U.S. PATENT DOCUMENTS

| | | | | |
|---|---|---|---|---|
| 8,009,115 | B2 * | 8/2011 | Walton | H01Q 3/01 343/700 MS |
| 9,716,313 | B1 * | 7/2017 | Mumcu | H01Q 3/04 |
| 2004/0252069 | A1 * | 12/2004 | Rawnick | H01Q 1/364 343/789 |
| 2011/0050524 | A1 | 3/2011 | Walton et al. | |
| 2012/0007778 | A1 | 1/2012 | Duwel et al. | |
| 2016/0205811 | A1 * | 7/2016 | Wang | H04M 1/026 165/296 |

FOREIGN PATENT DOCUMENTS

| | | | |
|---|---|---|---|
| EP | 2169764 | A1 | 3/2010 |
| WO | WO 2014042486 | A1 | 3/2013 |

OTHER PUBLICATIONS

Search Report and Opinion for European Application No. 14855347.2; dated Oct. 7, 2016.

* cited by examiner

ANTENNA, ANTENNA CONTROL METHOD, AND MOBILE TERMINAL

TECHNICAL FIELD

The disclosure relates to the technical field of antenna, and in particular to an antenna, a method for controlling antenna and a mobile terminal.

BACKGROUND

In recent years, with the development of the wireless communication technology, on one hand, a mobile phone device is provided with more and more functions, from the call and short message functions at the very beginning to the later terminal application components like Bluetooth, Global Positioning System (GPS) navigation, wireless local area network, mobile TV and Near Field Communication (NFC), more and more functions are integrated on the mobile phone device; on the other hand, from a user experience perspective, people hope that the mobile phone device can be made small, light and thin, and convenient to carry. Both of the two aspects make it increasingly difficult to design the mobile phone device; certainly, with the improvement of various chip manufacture techniques, the chip can be encapsulated smaller and smaller, which makes it possible to implement more and more functions on the same PCB board, but the space required by an antenna which serves as an air outlet for implementing these terminal application components cannot be reduced.

The current smart phone generally supports multiband network, Bluetooth, GPS, WIFI and other functions, then a multiband main antenna, a Bluetooth antenna, a GPS antenna, a WIFI antenna and other antennae are needed for implementing these functions together; to design and implement these antennae on the mobile phone at the same time, the design faces a great challenge. For achieving the excellent radiation performance, the antenna is usually set at edge or corner of the mobile phone device, and occupies a certain PCB space; generally, the more the space occupied by the antenna is, the better the radiation performance is. However, because there are too many antennae on the mobile phone device, the space allocated to each antenna is limited, and then the antenna performance cannot be optimized, which influences the user experience.

SUMMARY

The disclosure provides an antenna, a method for controlling antenna and a mobile terminal, for at least controlling the allocation of antenna spaces according to a terminal application component used by a user or a selection of the user, thereby improving the radiation performance of the antenna.

According to one aspect of the disclosure, an antenna is provided, which includes: a base plate, controlling apparatus and driving apparatus; wherein M*N microcell units are provided in the base plate, each of the microcell units is in communication with neighbouring microcell units, and liquid metal is provided in the multiple microcell units; the driving apparatus is connected with the controlling apparatus and the base plate respectively, wherein, the controlling apparatus generates a control signal according to one of pre-stored control matrixes, and sends the control signal to the driving apparatus; elements of the one of the control matrixes correspond to the microcell units on the base plate in a one-to-one manner to control whether the liquid metal is kept in the corresponding microcell units;

the driving apparatus drives, according to the control signal sent by the controlling apparatus, the liquid metal in the microcell units to flow in the microcell units; a metal body formed by the liquid metal serves as an antenna of a terminal application component.

Preferably, the pre-stored control matrixes of the controlling apparatus include the control matrix that multiple terminal application components simultaneously occupy the base plate when working simultaneously and the control matrix that each terminal application component exclusively occupies the base plate when working alone.

Preferably, the driving apparatus includes a miniature mechanical pump and a piezoelectric brake, wherein, the miniature mechanical pump drives the flowing of the liquid metal according to the control signal;

the piezoelectric brake keeps the liquid metal in the corresponding microcell unit according to the control signal.

Preferably, the control matrix that multiple terminal application components simultaneously occupy the base plate when working simultaneously is obtained through the following steps, selecting, aiming at the structure of a mobile terminal, an antenna space for each terminal application component in the mobile terminal, and designing an antenna shape in each antenna space, optimizing the antenna shape, and calculating, according to the antenna shape of each terminal application component, the control matrix which is obtained by arranging the antennae of all terminal application components in the base plate, wherein at least one row of microcell units not filled with the liquid metal is between the antennae;

the control matrix that each terminal application component exclusively occupies the base plate when working alone is obtained through the following methods: allocating, aiming at the structure of the mobile terminal, all the antenna spaces of the mobile terminal to one terminal application component, designing an antenna shape of the terminal application component, and calculating, according to the antenna shape of the terminal application component, the control matrix which is obtained by only arranging the antennae of the terminal application component in the base plate.

Preferably, the base plate adopts the polydimethylsiloxane base plate; and the liquid metal adopts the gallium-in alloy.

According to another aspect of the disclosure, a method for controlling antenna is provided, which includes that:

the mobile terminal receives a selection made by the user about whether to work in a common antenna mode or in an enhanced antenna mode;

when the user selects to work in the common antenna mode, the mobile terminal controls the flowing of the liquid metal in the microcell units in the base plate according to the control matrix that multiple terminal application components simultaneously occupy the base plate when working simultaneously, and controls the liquid metal to form, in the base plate, the antenna of each terminal application component supported by the mobile terminal;

when the user selects to work in the enhanced antenna mode, the mobile terminal determines the terminal application component used by the user currently, selects the control matrix that each terminal application component exclusively occupies the base plate when working alone, wherein the control matrix is corresponding to the terminal application component used by the user currently, and controls the liquid metal to form, in the base plate, the antenna of the terminal application component used by the user currently.

According to another aspect of the disclosure, the mobile terminal is provided, which includes the antenna; the antenna includes: the base plate, the controlling apparatus and the driving apparatus; wherein M*N microcell units are provided in the base plate, each of the microcell units is in communication with the neighbouring microcell units, and the liquid metal is provided in the multiple microcell units; the driving apparatus is connected with the controller and the base plate respectively, wherein the controlling apparatus generates the control signal according to one of the pre-stored control matrixes, and sends the control signal to the driving apparatus; the elements in the one of the control matrix correspond to the microcell units in the base plate in a one-to-one manner, so as to control whether the liquid metal is kept in the corresponding microcell units;

the driving apparatus drives, according to the control signal sent by the controlling apparatus, the liquid metal in the microcell units to flow in the microcell units; the metal body formed by the liquid metal serves as the antenna of the terminal application component.

Preferably, the pre-stored control matrixes of the controlling apparatus include the control matrix that multiple terminal application components simultaneously occupy the base plate when working simultaneously and the control matrix that each terminal application component exclusively occupies the base plate when working alone.

Preferably, the driving apparatus includes the miniature mechanical pump and the piezoelectric brake, wherein, the miniature mechanical pump drives the flowing of the liquid metal according to the control signal;

the piezoelectric brake keeps the liquid metal in the corresponding microcell unit according to the control signal.

Preferably, the control matrix that multiple terminal application components simultaneously occupy the base plate when working simultaneously is obtained through the following steps: selecting, aiming at the structure of the mobile terminal, an antenna space for each terminal application component in the mobile terminal, and designing the antenna shape in each selected antenna space, optimizing the antenna shape, and calculating, according to the antenna shape of each terminal application component, the control matrix which is obtained by arranging the antennae of all the terminal application components in the base plate, wherein at least one row of microcell units not filled with the liquid metal is between the antennae;

the control matrix that each terminal application component exclusively occupies the base plate when working alone is obtained through the following steps: allocating, aiming at the structure of the mobile terminal, all the antenna spaces of the mobile terminal to one terminal application component, designing the antenna shape of the one of the terminal application component, and calculating, according to the antenna shape of the one of the terminal application component, the control matrix which is obtained by only arranging the antennae of the terminal application component on the base plate.

To sum up, the beneficial effects of the disclosure include:

(1) the liquid metal antenna and the base plate made of flexile material to which the liquid metal antenna is attached may be conformal with the structural component shell of the mobile phone device, thereby making full use of the small space in the mobile phone device;

(2) when a certain wireless function is used according to the selection of the user, all the antenna spaces of the mobile phone device may be allocated to the functional antenna, thereby improving the radiation performance of the antenna, and improving the user experience satisfaction.

DETAILED DESCRIPTION OF THE EMBODIMENTS

In the terminal application component supported by the mobile terminal, the call function, as the most basic function, is used most frequently, and it requires for access to the mobile network, as long as the mobile terminal is opened, but other terminal application components like Bluetooth, GPS, WIFI and mobile TV need to open corresponding software applications, and then hardware application component start working, and the corresponding antennae are used, so these antennae will not be used simultaneously. Based on this, the application presents a method for using the antenna space reasonably, which includes that: with the fluidity of the liquid metal, the antenna spaces are allocated according to the need; when the user only uses a certain terminal application component of the mobile terminal, all the antenna spaces on the mobile terminal are allocated to the antenna of the terminal application component, the liquid metal may flow to the corresponding space, so that the antenna performance of the terminal application component used currently is furthest improved, and the user experience satisfaction is improved.

For making the technical solutions and the advantages of the disclosure more clear, embodiments of the disclosure are elaborated below in combination with the accompanying drawings. Note that, the embodiments and features in the embodiments in the application can be combined with each other on condition of not conflicting.

Figure 1:
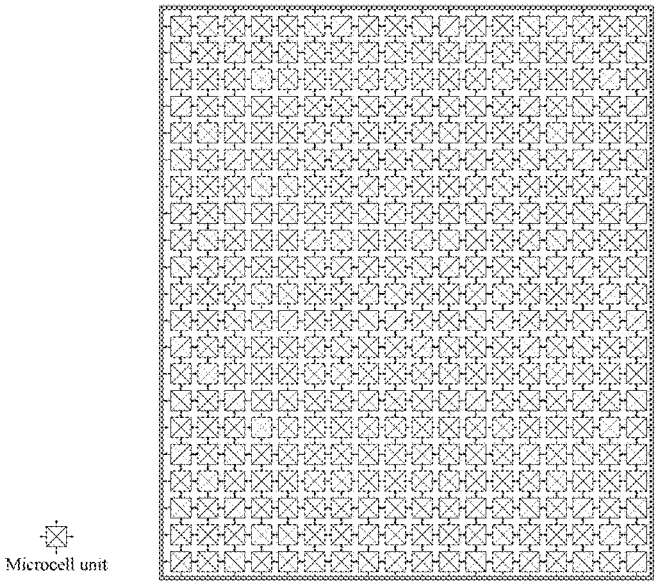
FIG. 1 shows a schematic diagram of a base plate and microcell units included in an antenna according to an embodiment of the disclosure.
Figure 2:
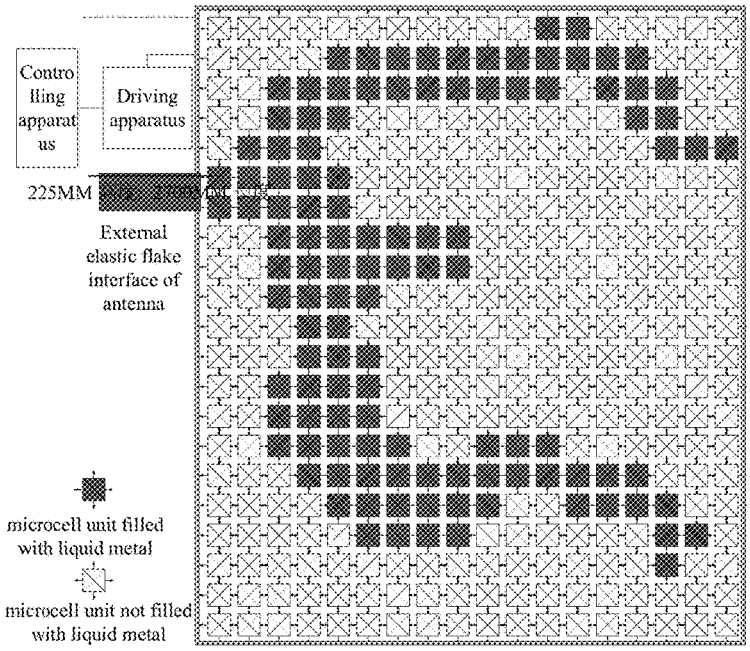
FIG. 2 shows a schematic diagram of an antenna according to an embodiment of the disclosure.

As shown in FIG. 1 and FIG. 2, the antenna of the application includes: a base plate, controlling apparatus and driving apparatus, wherein the driving apparatus is connected with the controlling apparatus and the base plate respectively.

M*N microcell units are etched in the base plate, each of the microcell units is in communication with the neighbouring microcell units via micro-fluidic channels, and there are M rows and N columns of micro-fluidic channels formed on the base plate. The liquid metal is provided in the multiple microcell units; the liquid metal may flow in the micro-fluidic channels or flow according to the control of the controlling apparatus; the controlling apparatus controls the flowing of the liquid metal to fill the corresponding microcell units, so as to form the corresponding shape to serve as the antenna.

The controlling apparatus generates the control signal according to one of the pre-stored control matrixes, and sends the control signal to the driving apparatus; the elements of the one of the control matrixes correspond to the microcell units in the base plate in a one-to-one manner, so as to control whether the liquid metal is kept in the corresponding microcell unit.

The driving apparatus drives, according to the control signal sent by the controlling apparatus, the liquid metal in the microcell units to flow in the microcell units; the metal body formed by the liquid metal serves as the antenna of the terminal application component.

As shown in FIG. 2, the controlling apparatus controls, through the driving apparatus, the liquid metal to fill the microcell units in the base plate to form the antenna with a specific shape.

The driving apparatus includes the miniature mechanical pump and the piezoelectric brake, wherein the miniature mechanical pump drives the flowing of the liquid metal according to the control signal; the piezoelectric brake keeps the liquid metal in the corresponding microcell unit according to the control signal.

An external elastic flake interface of the antenna is configured to connect the antenna with the terminal application component.

The liquid metal in the embodiment is required to have characteristics of good conductivity, low surface tension, being liquid at normal temperature, and so on; the liquid metal may adopt the gallium-in alloy (mass percent: 75% Ga, 25% In). The base plate in the embodiment adopts a flexible material, and has characteristics of being resistant to bend, being resistant to oxidation, and so on; the polydimethylsiloxane base plate may be adopted.

In the embodiment, both the base plate and the liquid metal of the antenna have characteristics of being stretchable, being bendable and deformable, and is easy to be conformal with the structural component of the mobile terminal; the antenna of the embodiment may be set in a non-visual area (a glass substrate) on the front and a cover area on the back of the mobile terminal.

In the embodiment, there are M*N microcell units in the base plate; each microcell unit has a filled state and a non-filled state, which are expressed by 1 and 0; the states of the M*N microcell units compose a control matrix $$C_{MN} = \begin{bmatrix} c_{11}, c_{12}, \dots c_{1N} \\ c_{21}, c_{22}, \dots c_{2N} \\ \vdots \quad \vdots \quad \ddots \quad \vdots \\ c_{M1}, c_{M2}, \dots c_{MN} \end{bmatrix},$$

each element $c_{mn}$ in the control matrix $C_{MN}$ corresponds to the state of the microcell unit at the m row and the n column, and controls whether the liquid metal is kept in the corresponding microcell unit; 1 represents filing, and 0 represents not filling. The matrix $C_{MN}$ corresponds to the antenna shape in a one-to-one manner. The matrix $C_{MN}$ is stored in a register of the controlling apparatus.

The pre-stored control matrixes of the controlling apparatus include the control matrix that multiple terminal application components simultaneously occupy the base plate when working simultaneously and the control matrix that each terminal application component exclusively occupies the base plate when working alone.

The liquid metal is driven by the miniature mechanical pump; after the mobile terminal is powered on, the miniature mechanical pump is powered on, and the piezoelectric brake is powered on at the same time; the miniature mechanical pump drives the liquid metal to flow in the micro-fluidic channel to form the specific shape according to the control of the controlling apparatus.

When the user selects the enhanced antenna mode to use, the miniature mechanical pump drives the liquid metal to flow in the micro-fluidic channels and controls the liquid metal to deform into the antenna shape corresponding to the control matrix. The miniature mechanical pump matches with current and voltage of the mobile terminal via a boost circuit, a buck circuit and a voltage stabilizing circuit.

Supposing that the mobile terminal supports r terminal application components, which are marked as function 1, function 2, . . . , function r, the liquid metal antenna is designed in the following two ways.

Figure 3:
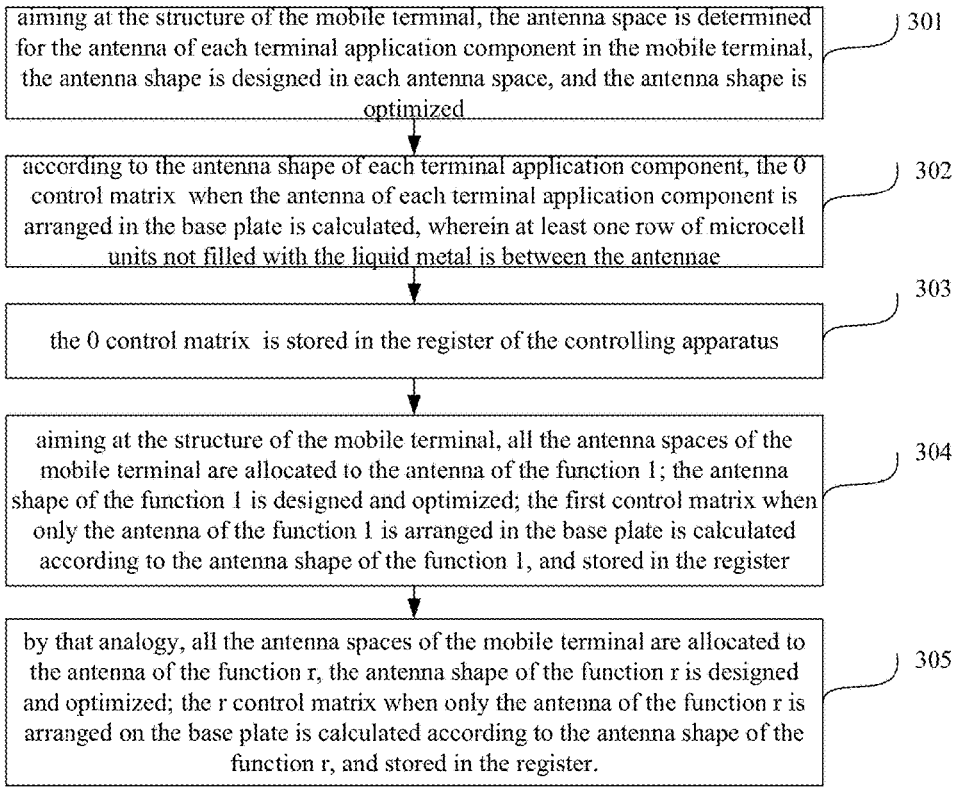
FIG. 3 shows a flowchart for storing a control matrix according to the disclosure.

As shown in FIG. 3, the step of storing the control matrixes includes the followings:

Step 301: aiming at the structure of the mobile terminal, the antenna space is determined for the antenna of each terminal application component in the mobile terminal, the antenna shape is designed in each antenna space, and the antenna shape is optimized;

Step 302: according to the antenna shape of each terminal application component, the 0 control matrix $C_{MN}$ when the antenna of each terminal application component is arranged in the base plate is calculated, wherein at least one row of microcell units not filled with the liquid metal is between the antennae;

Step 303: the 0 control matrix $C_{MN}$ is stored in the register of the controlling apparatus;

Step 304: aiming at the structure of the mobile terminal, all the antenna spaces of the mobile terminal are allocated to the antenna of the function 1; the antenna shape of the function 1 is designed and optimized; the first control matrix when only the antenna of the function 1 is arranged in the base plate is calculated according to the antenna shape of the function 1, and stored in the register; and Step 305: by that analogy, all the antenna spaces of the mobile terminal are allocated to the antenna of the function r, the antenna shape of the function r is designed and optimized; the r control matrix when only the antenna of the function r is arranged on the base plate is calculated according to the antenna shape of the function r, and stored in the register.

Figure 4:
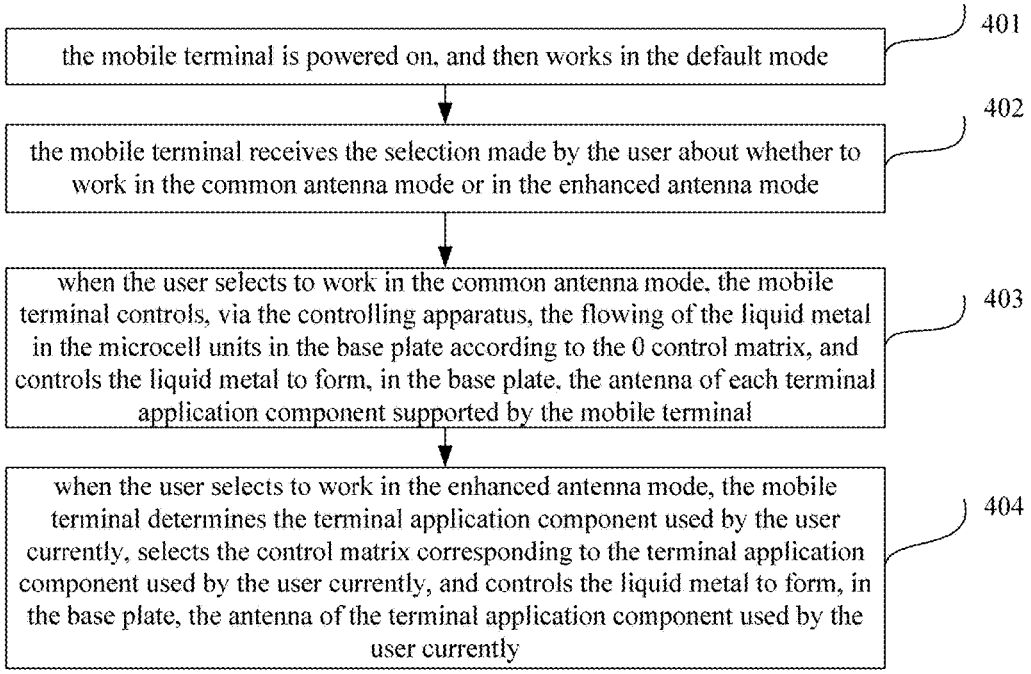
FIG. 4 shows a flowchart of a method for controlling an antenna according to the disclosure.

FIG. 4 is a flowchart of a method for controlling antenna according to the present embodiment; in the present embodiment, the mode of arranging the antennae of various terminal application components in the base plate is defined as the common antenna mode, and the mode that the antenna of a certain terminal application component exclusively occupies the base plate is defined as the enhanced antenna mode; the common antenna mode is taken as the default mode, that is, the mobile terminal works in the common antenna mode when powered on. The method includes the following steps:

Step 401: the mobile terminal is powered on, and then works in the default mode;

the default mode may be either the common antenna mode or the enhanced antenna mode; usually, the common antenna mode is adopted;

Step 402: the mobile terminal receives the selection made by the user about whether to work in the common antenna mode or in the enhanced antenna mode;

in the using process, the user may select the common antenna mode or the enhanced antenna mode to use;

Step 403: when the user selects to work in the common antenna mode, the mobile terminal controls, via the controlling apparatus, the flowing of the liquid metal in the microcell units in the base plate according to the 0 control matrix, and controls the liquid metal to form, in the base plate, the antenna of each terminal application component supported by the mobile terminal;

the controlling apparatus controls the liquid metal to deform according to the 0 control matrix, and keeps the changed shape unchanged;

Step 404: when the user selects to work in the enhanced antenna mode, the mobile terminal determines the terminal application component used by the user currently, selects the control matrix(es) (one or multiple of matrixes from the first control matrix to the r control matrix) corresponding to the terminal application component(s) used by the user currently, and controls the liquid metal to form, in the base plate, the antenna of the terminal application component used by the user currently.

The application also provides a mobile terminal, which includes the antenna; the antenna includes: the base plate, the controlling apparatus and the driving apparatus; wherein M*N microcell units are provided in the base plate, each of the microcell units is in communication with the neighbouring microcell units, and the liquid metal is provided in the multiple microcell units; the driving apparatus is connected with the controller and the base plate respectively, wherein, the controlling apparatus generates the control signal according to one of the pre-stored control matrixes, and sends the control signal to the driving apparatus; the elements in one of the control matrixes correspond to the microcell units in the base plate in a one-to-one manner, so as to control whether the liquid metal is kept in the corresponding microcell unit;

the driving apparatus drives, according to the control signal sent by the controlling apparatus, the liquid metal in the microcell units to flow in the microcell units; the metal body formed by the liquid metal serves as the antenna of the terminal application component.

The pre-stored control matrixes of the controlling apparatus include the control matrix that multiple terminal application components simultaneously occupy the base plate when working simultaneously and the control matrix that each terminal application component exclusively occupies the base plate when working alone.

The driving apparatus includes the miniature mechanical pump and the piezoelectric brake, wherein the miniature mechanical pump drives the flowing of the liquid metal according to the control signal;

the piezoelectric brake keeps the metal liquid in the corresponding microcell units according to the control signal.

The control matrix that multiple terminal application components simultaneously occupy the base plate when working simultaneously is obtained by the following steps: aiming at the structure of the mobile terminal, an antenna space for each terminal application component in the mobile terminal is selected, and the antenna shape in each antenna space is designed, the antenna shape is optimized, and the control matrix which is obtained by arranging the antennae of all terminal application components in the base plate is calculated according to the antenna shape of each terminal application component, wherein at least one row of microcell units not filled with the liquid metal is between the antennae;

the control matrixes that each terminal application component exclusively occupies the base plate when working alone are obtained through the following steps: aiming at the structure of the mobile terminal, all the antenna spaces of the mobile terminal are allocated to one terminal application component, the antenna shape of the terminal application component is designed, and the control matrixes which are obtained by only arranging the antennae of the terminal application components in the base plate respectively are calculated according to the antenna shape of the terminal application component.

The base plate adopts the polydimethylsiloxane base plate; the liquid metal adopts the gallium-in alloy.

The person skilled in the art may understand that all or part of the steps in the above method can be completed by related hardware instructed by a program; the program can be stored in a computer readable storage medium, such as a read-only register, a magnetic disc or a compact disc. Optionally, all or part of the steps in the above embodiments can also be implemented by one or multiple integrated circuits; correspondingly, various components/units in the above embodiments can be implemented in the form of hardware, or in the form of software function components. The application is not limited to any particular combination of hardware and software.

The above is only the preferred embodiments of the application and not intended to limit the application; for those skilled in the art, the application may have various modifications and changes. Any modifications, equivalent replacements, improvements and the like within the spirit and principle of the application should fall within the scope of the claims of the disclosure.

INDUSTRIAL APPLICABILITY

The disclosure may be applied to the technical field of antenna; the liquid metal antenna and the base plate made of flexile material to which the liquid metal antenna is attached may be conformal with the structural component shell of the mobile phone device, thereby making full use of the small space in the mobile phone device; when a certain wireless function is used according to the selection of the user, all the antenna spaces of the mobile phone device may be allocated to the functional antenna, thereby improving the radiation performance of the antenna, and improving the user experience satisfaction.

What is claimed is:

1. An antenna, comprising: a base plate, a controlling apparatus and a driving apparatus; wherein M*N microcell units are provided on the base plate, each of the microcell units is in communication with neighbouring microcell units, and liquid metal is provided in the multiple microcell units; and the driving apparatus is connected with the controlling apparatus and the base plate respectively, wherein, the controlling apparatus generates a control signal according to one of pre-stored control matrixes, and sends the control signal to the driving apparatus; elements of the one of the control matrixes correspond to the microcell units on the base plate in a one-to-one manner to control whether the liquid metal is kept in the corresponding microcell units;

the driving apparatus drives, according to the control signal sent by the controlling apparatus, the liquid metal in the microcell units to flow in the microcell units, wherein a metal body formed by the liquid metal serves as the antenna of a terminal application component;

wherein the pre-stored control matrixes of the controlling apparatus include the control matrix in which multiple terminal application components simultaneously occupy the base plate when working simultaneously and the control matrix in which each terminal application component exclusively occupies the base plate when working alone;

wherein the control matrix in which the multiple terminal application components simultaneously occupy the base plate when working simultaneously is obtained through the following steps: selecting, aiming at the structure of a mobile terminal, an antenna space for each terminal application component in the mobile terminal, designing an antenna shape in each selected antenna space, optimizing the antenna shape, and calculating, according to the antenna shape of each selected terminal application component, the control matrix which is obtained by arranging the antennae of all the selected terminal application components in the base plate, wherein at least one row of microcell units not filled with the liquid metal is between the antennae; the control matrix in which each terminal application component exclusively occupies the base plate when working alone is obtained through the following steps: aiming at the structure of the mobile terminal, allocating all the antenna spaces of the mobile terminal to one terminal application component, designing an antenna shape of the terminal application component, and calculating, according to the antenna shape of the terminal application component, the control matrix which is obtained by only arranging the antenna of the terminal application component in the base plate.

2. The antenna according to claim 1, wherein, the driving apparatus comprises a miniature mechanical pump and a piezoelectric brake, wherein the miniature mechanical pump drives the flowing of the liquid metal according to the control signal;

the piezoelectric brake keeps the liquid metal in the corresponding microcell units according to the control signal.

3. The antenna according to claim 1, wherein, the base plate adopts a polydimethylsiloxane base plate; the liquid metal adopts the gallium-in alloy.

4. The antenna according to claim 1, wherein, the driving apparatus comprises a miniature mechanical pump and a piezoelectric brake, wherein the miniature mechanical pump drives the flowing of the liquid metal according to the control signal;

the piezoelectric brake keeps the liquid metal in the corresponding microcell units according to the control signal.

5. The antenna according to claim 1, wherein, the base plate adopts a polydimethylsiloxane base plate; the liquid metal adopts the gallium-in alloy.

6. A method for controlling an antenna, comprising:

receiving, by a mobile terminal, a selection made by a user about whether to work in a common antenna mode or in an enhanced antenna mode;

when the user selects to work in the common antenna mode, the mobile terminal controlling the flowing of the liquid metal in the microcell units in the base plate according to the control matrix that multiple terminal application components simultaneously occupy the base plate when working simultaneously, and controlling the liquid metal to form, in the base plate, the antenna of each terminal application component supported by the mobile terminal;

when the user selects to work in the enhanced antenna mode, the mobile terminal determining a terminal application component used by the user currently, selects the control matrix that each terminal application component exclusively occupies the base plate when working alone, wherein the control matrix is corresponding to the terminal application component used by the user currently, and controlling the liquid metal to form, in the base plate, an antenna of the terminal application component used by the user currently.

7. A mobile terminal, comprising an antenna; wherein the antenna comprises a base plate, controlling apparatus and driving apparatus; wherein M*N microcell units are provided in the base plate, each of the microcell units is in communication with neighbouring microcell units, and liquid metal is provided in the multiple microcell units; the driving apparatus is connected with the controlling apparatus and the base plate respectively, wherein the controlling apparatus generates a control signal according to one of pre-stored control matrixes, and sends the one of the control signal to the driving apparatus; elements of the one of the control matrixes correspond to the microcell units in the base plate in a one-to-one manner to control whether the liquid metal is kept in the corresponding microcell units;

the driving apparatus drives, according to the control signal sent by the controlling apparatus, the liquid metal in the microcell units to flow in the microcell units, wherein a metal body formed by the liquid metal serves as an antenna of a terminal application component;

wherein the pre-stored control matrixes of the controlling apparatus includes the control matrix in which multiple terminal application components simultaneously occupy the base plate when working simultaneously and the control matrix in which each terminal application component exclusively occupies the base plate when working alone;

wherein the control matrix in which multiple terminal application components simultaneously occupy the base plate when working simultaneously is obtained through the following steps: selecting, aiming at the structure of the mobile terminal, an antenna space for each terminal application component in the mobile terminal, and designing an antenna shape in each antenna space, optimizing the antenna shape to the best, and calculating, according to the antenna shape of each terminal application component, the control matrix which is obtained by arranging the antennae of all the terminal application components in the base plate, wherein at least one row of microcell units not filled with the liquid metal is between the antennae; the control matrix in which each terminal application component exclusively occupies the base plate when working alone is obtained by the following steps: allocating, aiming at the structure of the mobile terminal, all the antenna spaces of the mobile terminal to one terminal application component, designing an antenna shape of one of the terminal application component, and calculating, according to the antenna shape of the terminal application component, the control matrix which is obtained by only arranging the antennae of the terminal application component in the base plate.

8. The mobile terminal according to claim 7, wherein the driving apparatus comprises a miniature mechanical pump and a piezoelectric brake, wherein the miniature mechanical pump drives the flowing of the liquid metal according to the control signal;

the piezoelectric brake keeps the liquid metal in the corresponding microcell units according to the control signal.

9. The mobile terminal according to claim 7, wherein the driving apparatus comprises a miniature mechanical pump and a piezoelectric brake, wherein the miniature mechanical pump drives the flowing of the liquid metal according to the control signal;

the piezoelectric brake keeps the liquid metal in the corresponding microcell units according to the control signal.

* * * * *